United States Patent [19]

Fabian et al.

[11] 4,391,879

[45] Jul. 5, 1983

[54] GRAVURE PRINTING BASE CYLINDER, AND METHOD OF ITS MANUFACTURE

[75] Inventors: Peter Fabian, Freigericht, Fed. Rep. of Germany; Theo Muller, Wuustwezel, Belgium

[73] Assignee: W. C. Heraeus GmbH, Hanau, Fed. Rep. of Germany

[21] Appl. No.: 326,506

[22] Filed: Dec. 2, 1981

[30] Foreign Application Priority Data

Dec. 12, 1980 [DE] Fed. Rep. of Germany ..... 3046757

[51] Int. Cl.[3] ..... B41F 13/08; B41F 35/00

[52] U.S. Cl. ..... 428/551; 428/553; 101/170; 101/153; 29/132

[58] Field of Search ..... 101/170, 153, 375, 401; 29/132; 428/551, 553

[56] References Cited

U.S. PATENT DOCUMENTS

| | | | |
|---|---|---|---|
| 1,643,046 | 9/1927 | Ballard | 101/401 |
| 1,831,645 | 11/1931 | Ballard | 101/401 |
| 2,127,824 | 8/1938 | Leuchter | 101/401 |
| 2,776,256 | 1/1957 | Eulner et al. | 101/170 |
| 3,923,610 | 12/1975 | Bergin et al. | 101/170 |
| 4,060,882 | 12/1977 | Pospisil et al. | 29/132 |

*Primary Examiner*—Brooks H. Hunt

*Attorney, Agent, or Firm*—Frishauf, Holtz, Goodman & Woodward

[57] ABSTRACT

A roto-gravure printing base cylinder is made by providing a cylindrical body (1), for example of steel, and applying thereover a cover layer (2) by thermal spraying, for example plasma-spraying, or arc-spraying. The cover layer is made of a material which is inert with respect to electrolytes used in applying a further copper layer over the cover layer to form a finished roto-gravure cylinder for optical engraving, for example an electrochemical valve metal, preferably tantalum, niobium or, most desirably, titanium oxide, forming a matrix in which, before application of the material as a layer on the steel cylinder, electrochemically active materials are applied made of a metal, preferably of the platinum group or other noble metal, and uniformly distributed over the surface, settled on the matrix material.

15 Claims, 1 Drawing Figure

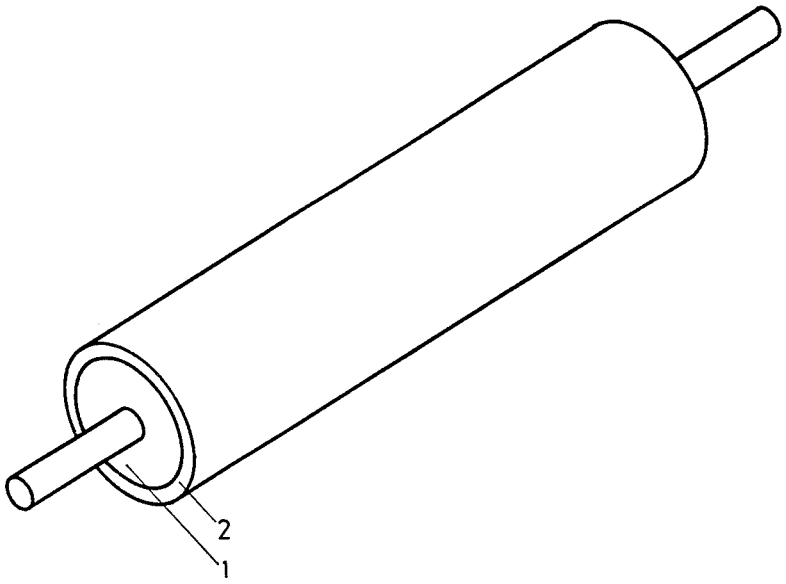
2
1

GRAVURE PRINTING BASE CYLINDER, AND METHOD OF ITS MANUFACTURE

The present invention relates to a gravure printing cylinder, and more particularly to a reusable base cylinder structure for use in gravure printing on which a copper coating can be applied which is removable for re-use of the cylinder base structure, and to a method of its manufacture.

BACKGROUND

Printing cylinders, particularly for use in photogravure printing, but also suitable for use in some copy apparatus, have previously been made by mechanically working steel cylinders of relatively long axial length, polishing the cylinders and balancing them, since they must be operated at high speed. These cylinders usually are of thick wall construction since, particularly at high printing speed, they are subject to substantial mechanical stress.

The steel cylinder, forming a carrier, has a copper layer of about 1 mm thickness applied to its circumference, typically by electrolytic deposition. This layer must be smooth at the outer circumference and dense. Thus, during deposition, which takes about 15 hours, it is continuously compacted by a jewel roller, for example of agate, and rolling with the steel cylinder on which the copper layer is being deposited. This copper layer, then, has a layer of silver applied thereover; over the silver layer, a further copper layer is electrolytically deposited. The final or further copper layer then is used as the printing surface. After the customary photolithographic processes, the depressions within the outer copper layer are etched in by a chemical etch. The depth of the depressions or engravings are in the order of about between 0.02 to 0.03 mm.

The printing roller, that is, the composite of steel body, copper layer, silver separating layer, and final copper printing layer, is then used in printing, for example magazines and the like. After the printing run is completed, the outer coating is removed from the printing roller by mechanical means, particularly by stripping off the outer layer using tongs, gripping instruments, and the like. A new silver layer is then applied, a new copper layer deposited over the silver layer, and the cylinder can be re-used for a renewed photographic exposure, etching, and ready for printing with a new subject matter.

The system above described, which is well known and has been practised over many decades, has one disadvantage: It is difficult to remove the outer copper jacket. During this removal step, damage to the roller body, forming the base thereof, frequently occurs. This, then, requires reworking of the printing roller, usually by the manufacturer, thus disassembly of the roller from a printing machine, re-assembly, shipping, and the like. Since the rollers are heavy, difficult to handle, and awkward due to their size and shape, reworking is expensive.

THE INVENTION

It is an object to provide a printing roller body forming a composite roller which is so constructed that an outer copper jacket can readily be applied for subsequent photolithographic exposure to form the printing image in accordance with standard procedures, and yet can be readily removed, for re-application of a new copper jacket for exposure with different subject matter.

Briefly, the base cylinder is constructed by forming a steel roller, as well known, above which a layer is applied which is inert with respect to an attack by an electrolyte, yet electrically conductive and electrochemically active. In accordance with the invention, the layer over the base body comprises a matrix of an oxide of an electrochemical valve metal, such as titanium, tantalum, or niobium, for example, in which particles of a noble metal, such as platinum or another metal of the platinum group, iridium or ruthenium, are homogeneously distributed. Preferably, the matrix is made of titanium oxide in the form of $TiO_{2-x}$, in which $x=0.04$ to 0.06; the matrix, thus, is understoichiometric titanium oxide, in the form of granules, in which platinum particles in a quantity of from 0.1 to 10%, preferably about 1 to 5%, with respect to the mass of the matrix, are included.

The layer is impervious with respect to the electrolyte used in the plating bath to add the final copper layer; a typical thickness is between about 0.05 mm to 1 mm, with a preferred range being between 0.05 and 0.15 mm, most desirably approximately between 0.08 and 0.12 mm.

The layer can be applied by first forming the composite of the electrochemical valve metal oxide with the noble metal, as described, and then applying this composite by a thermal spray process on the carrier body, typically the steel carrier. A plasma spray process is suitable, although, also, an arc spray method may be used.

The method of applying the layer on the body is simple; the composite body, with the intermediate layer applied, can then be electro-plated with copper to form the final copper layer which then is photo-engraved in accordance with standard processes. To remove the photo-engraved copper layer, the used roll is again introduced into an electrolytic bath, with reverse polarity, so that the previously cathodically applied copper is now anodically removed.

The structure has the advantage that the layer is readily applicable, in a rapid and efficient process, thus permitting wider application of roto-gravure printing; no mechanical steps are needed to remove the outer gravure layer, after it has been engraved, and thus the danger of damage to the cylinder body, with the layer thereon on which the final gravure copper printing layer is applied, is effectively prevented. The final layer applied, for example in a printing plant, will only utilize copper; expensive noble metals for additional application, such as silver, need not be used. Any noble metals on the cylinder structure are finely dispersed within the electrochemical valve metal oxides. The term "valve metal" is defined for example in U.S. Pat. No. 3,632,498.

DRAWING

The single FIGURE is an isometric view of a gravure base roller.

The printing roller is a composite formed of a carrier 1, for example, steel, over which a layer 2 is applied, formed of electrochemical valve metal oxide in which particles of a noble metal are finely dispersed.

General example: A cylinder or roller body 1 is made of steel of customary and standard suitable construction. Without any intermediate layer, such as silver, a layer material was applied by plasma-spraying. The layer material was made of $TiO_{1.94-1.96}$ with 3% platinum, in form of finely dispersed particles, uniformly mixed through, the platinum being settled on the titanium oxide compound. The platinum was uniformly distributed and present on the grains of the titanium oxide. The applied layer, thus, is smooth, of dense and uniform surface characteristic, with a depth of coarseness of less than 25 μm, for example between about 5 to 15 μm. The thickness of the layer was in the range of about 0.1 mm, particularly after mechanical working such as grinding and polishing.

A copper coating was then applied over the titanium-platinum layer, in accordance with standard procedures. The copper coating was then photo-engraved to form a roto-gravure cylinder.

The roto-gravure cylinder was operated with good success. It has been found that the application of the copper jacket, on which the image is photo-engraved could be easily and simply obtained by cathodic deposition. The copper coating can be removed, just as easily by merely reversing the polarity of electrical connections thereto in an electrolytic bath, by anodic removal.

It has been found that a composite base gravure roller, with a titanium oxide-platinum layer thereon, can readily be used with more than 125 cycles of application of copper jacket outer gravure layers, and subsequent removal of the copper gravure layers after use, and re-application of a new layer for a new image content.

Example 1, manufacture of coating material: The matrix material, such as titanium oxide, is introduced into a fluidized bed. A salt of active material of a noble metal, such as platinum, in an easily distilled solvent is sprayed into the fluidized bed, in counter current, in form of a fog. The particles of the matrix material, that is, for example the titanium oxide, are thus coated with the active material by highly homogeneous distribution, that is, the particles of the active material are uniformly distributed on the surface of the granules of the matrix. In this method, thus, the matrix material such as titanium oxide is provided in the form of a powder or in granular form, the active material, such as a noble metal, for example platinum, is introduced in form of a salt, dissolved in an easily distilled solvent.

2.5 g hexachloroplatinate are dissolved in 120 ml methanol. Sub-stoichiometric titanium oxide, having a grain size of −100+37 mym, in a quantity of 100 g, is placed in a vaporization dish.

The hexachloroplatinate solution is then added to the titanium oxide, and subsequently, under continuous stirring, the methanol is evaported-off over a water bath.

When the power is almost dry, it is finished-dried in a dryer, at a temperature of about 105° C. The powder is then removed from the dryer furnace and comminuted in a mortar, so that the resulting conglomerate again achieves its original grain size.

The powder is then put in a crucible and placed in a box or muffle furnace, and heated therein to 550° C. for 4 hours.

Upon removal of the powder from the furnace, and cooling, it is lightly ground in a mortar to the original grain size. The powder is then passed through a sieve and with a grain size of −100 ±37 mym suitable as a spraying powder for coating of the steel roller body 1. The grain size −100 ±37 microns corresponds*

*to passing through a mesh of 104 microns No. 150, but being rejected by a mesh of 89 microns No. 170 respectively of test siews US-BS 410 NORMAL.

Example, coating step: A steel cylinder with a diameter of between about 20 to 40 cm, and a length of about 2 m, is pretreated, as customary, for example by sandblasting.

The pretreated steel cylinder is then coated with a powder, for example titanium oxide with platinum settled thereon, by a plasma, for example of the type F 4 made by the company "Plasmatechnik".

The powder need not necessarily contain titanium oxide activated with platinum. Other materials are suitable. For example:

Rather than using platinum, a platinum-type metal or iridium or ruthenium, or the oxides thereof, may be used; the selected metal is mixed with the electrochemical valve metal and, uniformly distributed, is settled thereon. Noble metals of the platinum group such as gold and silver may also be used.

The characteristics of the additives to the electrochemical valve metal must be to be electrically conductive, preferably well or highly electrically conductive, and electrochemically active. This, of course, is true also for the oxides of the platinum metal group. The electrical conductivity rises with increasing percentage presence of noble metals in the with increasing percentage presence of noble metals in the mixed or compound powder formed by the matrix, plus active components. A balance must be struck based on economic considerations, since, due to the high cost of noble metals, the proportion thereof should be limited. Suitable valve metal oxides, usually, may be of a customary commercial type, such as the commercially available titanium oxide sold under the tradename "Amperit" by the firm Starck.

The conditions of the plasma-spraying process were: current: 400 A; potential difference: 70 V plasma gas: nitrogen, 26 l per minute, hydrogen 2 l per minute. Spraying distance: 15 cm.

Alternative method: With similar materials, rather than using plasma-spraying, a well known and customary arc-spraying method may also be used.

Example, final manufacture of roto-gravure cylinder: The steel cylinder, coated by plasma-spraying or arc-spraying, as above, is coated with a copper layer by electrolytic deposition. Electrolyte: 0.5 N-copper sulfate solution, in 5% sulphuric acid.

Electrolytic operating conditions:

Temperature: ambient room temperature, about 20° C.

Current: 100 A/m$^2$. Time: for cathodic deposition, 20 minutes.

For removal of the copper layer, after use, the same bath and conditions may be used, but the time required is slightly longer. Anodic removal: 25 minutes.

Basically, the steel roller 1 must have a coating thereon in which the electrochemically active particles are bound with an electrically conductive matrix material which further is not attacked by the electrolyte to be used, before application on the steel roller by one of the thermal spraying methods.

The term "electrochemical valve metal" refers to a metal which, when used as an anode, will form a non-conductive oxide coating thereon; such metals are also referred to as "film-forming" metals and include, in general, titanium, tantalum, niobium, aluminum, zirconium, bismuth, tungsten, hafnium. The preferred materials for use in the present invention are titanium, tantalum, and niobium, with titanium oxide being particularly suitable due to its ready commercial availability at economical rates.

Film-forming metals are described, for example, in U.S. Pat. No. 3,632,498, to which reference may be had with respect to such materials.

We claim:

1. Printing base cylinder, for plating in an electrolyte bath, having
a cylindrical body (1);
and a cover layer (2) thereon which is electrically conductive, electrochemically active, and inert with respect to the plating electrolyte,
wherein, in accordance with the invention,
the cover layer (2) comprises
a matrix formed by an oxide of a valve metal;
and particles homogeneously distributed in said matrix comprising at least one of the materials selected from the group consisting of:
a noble metal, iridium; ruthenium.

2. Cylinder according to claim 1, wherein the matrix comprises an oxide of titanium, tantalum, or niobium.

3. Cylinder according to claim 1, wherein the matrix comprises under-stoichiometric titanium oxide in the form of granules, and the particles comprise platinum particles of from 0.1 to 10%, preferably 1 to 5%, by weight, of the matrix settled thereon.

4. Cylinder according to claim 1, wherein the matrix comprises titanium oxide in the form of $TiO_{2-x}$,
wherein x=0.04 to 0.06.

5. Cylinder according to claim 4, wherein the particles comprise platinum.

6. Cylinder according to claim 5, wherein the platinum particles are present, by weight, by about 1–5%, with respect to the matrix.

7. Cylinder according to claim 1, wherein said cover layer (2) has a thickness of from between about 0.05 mm to about 1 mm.

8. Cylinder according to claim 7, wherein the thickness of the cover layer (2) is between about 0.08 and 0.12 mm.

9. Cylinder according to claim 6, wherein the cover layer (2) is dense or liquid-tight with respect to the electrolyte bath, and has a thickness of between about 0.05 and 0.15 mm.

10. A roto-gravure printing cylinder comprising
the printing cylinder of claim 9;
and an outer layer or jacket of copper suitable for photo-engraving applied over said cover layer (2).

11. Method of making a gravure printing base cylinder for use in an electrolyte bath having
a cylinder body (1) and a cover layer (2) applied thereover, comprising the steps of
settling electrically conductive particles on a film-forming or valve metal oxide,
which particles are inert with respect to the electrolyte of the electrolyte bath, to form a cover coating layer substance;
and, after forming said substance, applying said substance in powder or granular form, by thermal spraying on the cylindrical body (1) to thereby form said cover layer (2) thereon.

12. Method according to claim 11, wherein the applying step comprises plasma-spraying.

13. Method according to claim 11, wherein said applying step comprises arc-spraying.

14. Method of making a roto-gravure printing cylinder
comprising: carrying out the steps of claim 11
and then immersing the coated cylinder body (1) with the cover layer (2) thereon in the electrolytic bath and depositing a copper jacket on said cover layer (2).

15. Method of removing a roto-gravure copper jacket from a rotor-gravure printing cylinder
wherein said printing cylinder comprises the cylinder of claim 10
including the step of immersing said printing cylinder in an electrolyte bath;
and removing said copper jacket by anodic removal, with application of current polarized to remove the copper jacket from said cover layer.

* * * * *